US005782999A

United States Patent [19]

Kostrubanic

[11] Patent Number: 5,782,999

[45] Date of Patent: Jul. 21, 1998

[54] STEEL FOR ENAMELING AND METHOD OF MAKING IT

[75] Inventor: James M. Kostrubanic, Pittsburgh, Pa.

[73] Assignee: USX Corporation, Pittsburgh, Pa.

[21] Appl. No.: 685,967

[22] Filed: Jul. 22, 1996

[51] Int. Cl.[6] ..... C21D 8/02; C22C 38/06; C22C 38/12

[52] U.S. Cl. ..... 148/320; 148/541; 148/602

[58] Field of Search ..... 148/541, 602, 148/320; 420/127

[56] References Cited

U.S. PATENT DOCUMENTS

| | | | |
|---|---|---|---|
| 3,436,808 | 4/1969 | Kotyk | 29/527 |
| 3,876,390 | 4/1975 | Elias et al. | 29/196.2 |
| 4,113,517 | 9/1978 | Nakaoka et al. | 148/2 |
| 4,368,084 | 1/1983 | Irie et al. | 148/12 C |
| 5,137,584 | 8/1992 | Jesseman | 148/537 |
| 5,292,383 | 3/1994 | Osawa et al. | 148/320 |

FOREIGN PATENT DOCUMENTS

| | | | |
|---|---|---|---|
| 934275 | 9/1973 | Canada | 148/31 |

OTHER PUBLICATIONS

ASTM Designation A 424–92 "Standard Specification for Steel, Sheet for Porcelain Enameling", Oct. 1992.

*Primary Examiner*—Deborah Yee
*Attorney, Agent, or Firm*—William L. Krayer

[57] ABSTRACT

An enameling steel having excellent strength after fire includes up to 0.008% C, 0.25–0.35% Mn, 0.03–0.05 Al, 0.010 to 0.014 N and 0.020–0.025 Nb.

7 Claims, 1 Drawing Sheet

STEEL FOR ENAMELING AND METHOD OF MAKING IT

TECHNICAL FIELD

This invention is a steel useful for porcelain enameling, sometimes known as vitreous enameling, and a method of making it. A typical use for this type of steel is in automatic laundering machines.

BACKGROUND OF THE INVENTION

ASTM Designation A 424-92 defines standard specifications for three types of steel for porcelain enameling. This invention is directed particularly to Type I enameling steel, which is characterized by "an extremely low carbon level," i.e. a maximum of 0.008% by weight. The ASTM standards also specify maximum weight percentages of manganese (0.40), phosphorous (0.020) and sulfur (0.030).

A part is made by first forming the base from steel sheet, then covering the surface of the base with the enameling material, which may be a ground glass cover or a wet slip, and firing the coated part to form an enamel which adheres to the surface of the steel. There are many variations known in the art in the physical and chemical compositions of the enameling material, preparation of the steel surface, coating of the raw glass/enamel, and the temperature and duration of the firing step.

Type I enameling steels are decarburized during annealing, creating voids within the steel which aid in reducing hydrogen-related enameling defects. During the enamel firing operation atomic hydrogen is generated due to the high firing temperatures which break down hydrated compounds in the enamels. This atomic hydrogen readily diffuses into the steel during firing due to the increased solubility of hydrogen in steel with increasing temperature. Upon cooling the part, the solubility of hydrogen in the steel again decreases; the hydrogen must diffuse back out of the steel and recombine to form molecular hydrogen. Typically, this occurs at the steel surface. Voids within the steel, however, may also serve as molecular hydrogen holding sites, i.e. the atomic hydrogen can recombine in the voids and remain within the steel. This greatly reduces the occurrence of hydrogen related defects.

Type III vacuum degassed enameling steels also possess ultra low carbon levels (<0.008%, commonly 0.003–0.005%). These steels, however, generally contain a very low density of voids because of the initially low carbon content. In these steels, nearly all of the atomic hydrogen must diffuse out to the steel surface and recombine, greatly increasing the occurrence of hydrogen related defects.

Recrystallization and massive grain growth typically occur in Type I enameling steels after only a few percent prestrain as prescribed by ASTM test C 744-88 (reapproved 1994). This produces a very low Strength After Fire, promoting damage of the enamel-ware component during service.

It is well known that the rolling, finishing and coiling temperatures and other processing conditions affect the final microstructure of the steel. Generally, the hot rolling and finishing temperatures are maintained high enough to assure finishing in the single phase gamma (austenite) region, this will require a higher temperature for ultra low carbon steels than for low carbon steels. After the last pass of a low carbon steel (Type I enameling), the microstructure passes through a two phase region (alpha+gamma) and then with further cooling, into a two phase (alpha+iron carbide) region. The strip is usually coiled in the ferrite and iron carbide region, generating two distinct phases. In the past, for continuous cast Type I enameling steels (aluminum killed), the initial carbon content and processing conditions have not been combined with appropriate alloying additions to generate precipitates necessary to assure good Strength After Fire in the final product. Strength After Fire has been elusive and does not seem to appear as an objective in very many patents.

A 1969 U.S. Patent No. 3,436,808, to Kotyk, makes an enameling steel having less than 0.008% carbon, but has added phosphorous and does not add niobium, nitrogen or aluminum as in the present invention.

Canadian patent 934,275 discloses an enameling stock and particularly a process for making it in traditional open hearth, basic oxygen, or electric furnaces. Niobium and nitrogen are added, and the product is decarburized to less than 0.008%. However, the steel is not aluminum killed and not made by continuous casting as is the present invention.

The above cited Canadian patent is discussed by Jesseman in U.S. Pat. No. 5,137,584, which adds aluminum and niobium but carries nitrogen only as an impurity, and conducts an annealing step without decarburizing, thus providing a steel with at least 0.02% carbon, apparently to qualify as a Type II enameling steel.

Elias, in U.S. Pat. No. 3,876,390, adds aluminum and niobium but not nitrogen; more importantly, the steel is vacuum degassed, meaning that the beginning carbon content is significantly lower than in the present invention.

Irie et al, in U.S. Pat. No. 4,368,084, employ aluminum and niobium, but do not add nitrogen. Also the continuous non-decarburizing anneal used by Irie et al creates microstructures different from those of the present application. Irie et al begin with an ultra low carbon content.

A continuous anneal is also used by Nakaoka et al in U.S. Pat. No. 4,113,517 to make a steel having no added nitrogen; the present invention is clearly outside the Al/N relationship of Nakaoka's FIG. 1.

SUMMARY OF THE INVENTION

The present invention is an aluminum-killed, continuous cast, renitrogenized, decarburized Type I enameling steel having a controlled amount of added niobium. The steel has improved strength after fire.

Hot rolling after continuous casting employs a slab reheat (hot rolling) temperature of 2200°–2400° F., preferably 2250°–2300° F., followed by a finishing temperature within the gamma phase region, preferably 1570°–1600° F. and a coiling temperature of 1300°–1400° F., preferably 1350°–1380° F. The specified coiling temperature promotes the formation of large angular carbides which later influences the void structure. It is cold reduced using at least 65% cold reduction to effectively break up and fracture the iron carbides. Annealing is performed by open coil annealing using a decarburizing atmosphere and a soak temperature of 1300° F.±50° for up to six hours. The decarburizing anneal effectively reduces or removes the iron carbides creating voids within the steel. The composition of the steel in weight percent prior to the decarburizing anneal is as follows:

| | C | Mn | P | Si | Al | N | B | Nb |
|---|---|---|---|---|---|---|---|---|
| Min | 0.04 | 0.25 | | | 0.03 | 0.010 | | 0.020 |
| Max | 0.06 | 0.35 | 0.012 | 0.01 | 0.05 | 0.014 | 0.0003 | 0.025 |

After the decarburizing anneal, the carbon content is no higher than 0.008 weight percent.

DETAILED DESCRIPTION OF THE INVENTION

Figure 1:
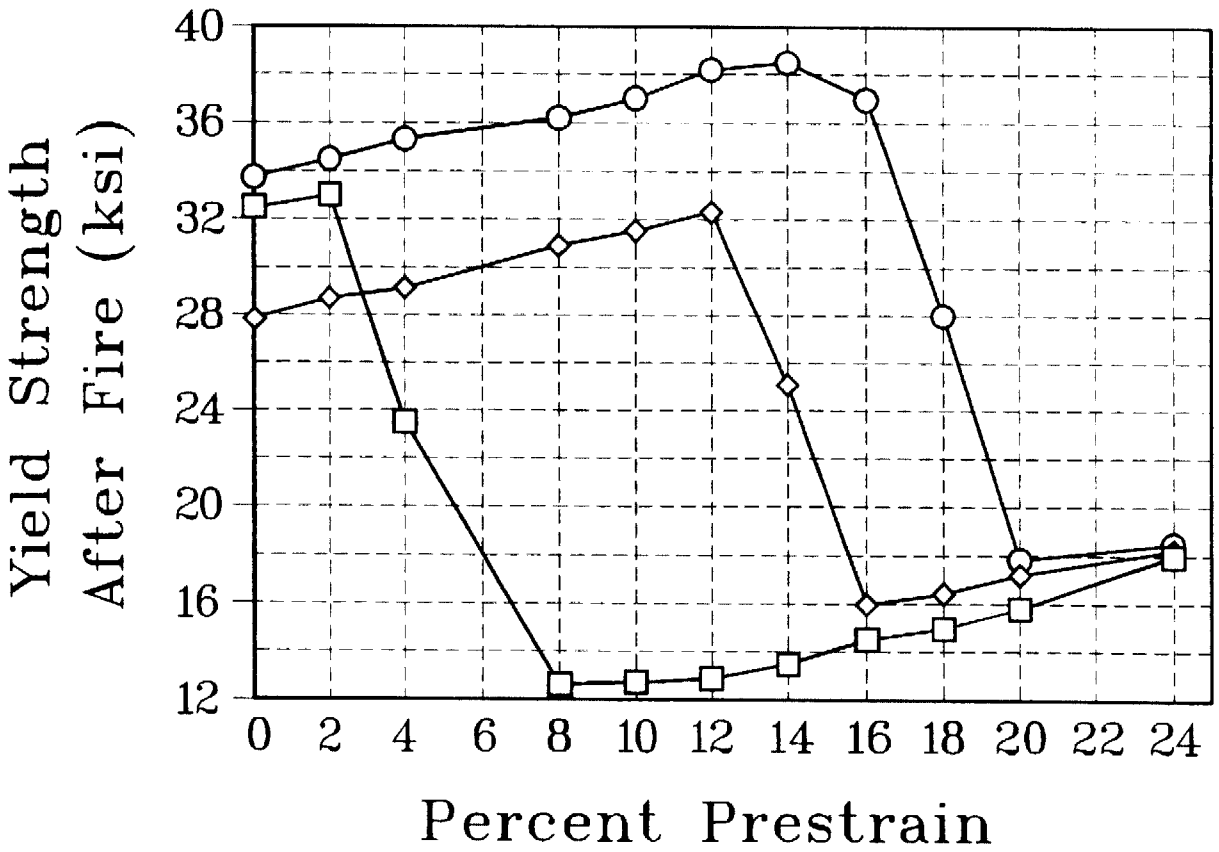
FIG. 1 shows the effects of increasing prestrain on yield strength after fire for the enameling steel of the invention compared with two other Type I enameling steels.

My steel is made by continuous casting. Prior to the continuous casting process, the steel contains 0.04 to 0.06 weight percent carbon and 0.25 to 0.35 weight percent manganese. Niobium in the range of 0.02 to 0.025 is added. Nitrogen is also added, to achieve the amount specified above. The steel is aluminum killed prior to casting, using 0.03 to 0.05% by weight aluminum, to reduce the oxygen content to 0.008% or below.

Hot rolling is performed at a slab reheat temperature within the range of 2200° to 2400° F., preferably 2250° to 2300° F., and finishing is conducted within the gamma phase region, preferably at 1570° to 1600° F. and a coiling temperature of 1300° to 1400° F., preferably 1350°–1380° F. At least 65% cold reduction is employed to break up and fracture the iron carbides.

While open-coil annealing is generally useful in the present invention, the preferred open coil annealing procedure is performed in a batch anneal furnace. The coil is wound loosely with a wound wire inserted between the wraps, as is standard practice for open coil annealing. The annealing cycle comprises heating the coil(s) at a non-critical rate up to a cold spot temperature of about 1150° F. (temperature at the bottom of the stack). At this point, steam is introduced into the furnace while continuing to add heat. This process is maintained until the carbon monoxide (CO) content reaches 0.4%. After reaching 0.4% CO, heat and steam are continuously added for one additional hour to assure proper decarburization. The steam is then shut off and the atmosphere is converted to one of a slightly deoxidizing composition, typically a mixture of nitrogen and hydrogen. The heat is maintained for at least one additional hour. After reaching an average temperature of 1290° F. (hot and cold spot), the heat is shut off and cooling begins. Cooling is performed at various non critical rates, influenced by cooling covers and water sprays.

The data shown in Table I are repeated in graphic form in FIG. 1. They represent the strength after fire for test specimens of steel after prestrain and firing, using the procedure prescribed in ASTM Designation C 774-88 (Reapproved 1994), except that the specimens were fired at 1500° F. for four minutes instead of the ASTM-specified 1450°. Generally, the procedure requires that the test specimens are strained, the strain is measured by an extensiometer, the specimens are then fired, air-cooled, descaled by pickling, and then tested for yield strength. Strength values in Table I are in ksi—thousand pounds per square inch. The steel of the invention is the "Renitrogenized Control with Niobium." Essentially, a comparison was made among the more or less conventional enameling steel of the control, whose data points are represented in FIG. 1 by squares, the control having an amount of nitrogen within the range I use in my invention, but without the niobium ("Renitrogenized Control Steel", data points represented in FIG. 1 as diamonds), and the steel of my invention ("Renitrogenized Control with Niobium"—circles in FIG. 1).

TABLE I

| Percent Prestrain | Control Steel | Renitrogenized Control Steel | Renitrogenized Control with Niobium |
|---|---|---|---|
| 0 | 32.4 | 27.8 | 33.8 |
| 2 | 33.0 | 28.7 | 34.4 |
| 4 | 23.6 | 29.1 | 35.3 |
| 8 | 12.6 | 30.9 | 36.2 |
| 10 | 12.7 | 31.6 | 37.0 |
| 12 | 12.8 | 32.3 | 38.2 |
| 14 | 13.5 | 25.1 | 38.4 |
| 16 | 14.5 | 15.9 | 37.0 |
| 18 | 15.0 | 16.4 | 28.0 |
| 20 | 15.8 | 17.1 | 17.8 |
| 24 | 18.1 | 18.3 | 18.6 |

It will be seen that the strength after fire of the conventional steel falls significantly after 2 percent prestrain, while the steel of the invention maintains high levels of yield strength to about 18 percent prestrain and beyond. Persons skilled in the art will realize that the results show that my steel is far better for enameling than either of the comparative steels. Persons skilled in the art may also observe that my range for niobium is relatively narrow. I find that concentrations of niobium lower than 0.020 will not have the desired effect on strength after firing, and that concentrations higher than 0.025 will damage the formability of the steel and decrease the amount of voids present within the steel.

While the data are most useful to compare the results among the three steels actually tested, it is clear that the combination of nitrogen and niobium contents I use provides dramatic differences in Strength After Fire in the range of 4–12% prestrain and most notably in the range of 14–18% prestrain. My steel can be characterized as exhibiting at least 34 ksi yield strength after fire following 14% prestrain.

I claim:

1. A steel sheet useful for porcelain enameling comprising, by weight, up to 0.008% carbon, 0.25 to 0.35% Mn, 0.03 to 0.05% Al, 0.010 to 0.014% N, below 0.008% O, and 0.020 to 0.025% Nb, and the balance iron, said steel exhibiting excellent yield strength after fire following 14% prestrain.

2. Steel sheet of claim 1 having at least 34 ksi yield strength after fire following 14% prestrain.

3. Steel sheet of claim 1 having no more than 0.012% P, 0.01% Si, and 0.0003% B.

4. Process for making a steel useful for enameling comprising making a liquid steel including 0.25–0.35% Mn in a vessel, adding 0.020 to 0.025% niobium thereto, adding 0.03 to 0.05% aluminum under conditions to deoxidize the steel, continuous casting said steel, reheating said steel, hot rolling said steel at a temperature of 2200° to 2400° F., finishing said steel within the gamma phase region, coiling at 1300° to 1400° F., and open-coil annealing said steel using a decarburizing atmosphere.

5. Process of claim 4 wherein coiling is conducted at 1350°–1380° F.

6. Process of claim 4 wherein the hot rolling temperature is 2250°–2300° F.

7. Process of claim 4 wherein the finishing temperature is 1570°–1600° F.

* * * * *